US006447402B2

(12) United States Patent
Moran

(10) Patent No.: US 6,447,402 B2
(45) Date of Patent: Sep. 10, 2002

(54) GOLF TRAINING DEVICE

(76) Inventor: Thomas F. Moran, 65 Hastings La., Chagrin Falls, OH (US) 44022

( * ) Notice: Subject to any disclaimer, the term of this patent is extended or adjusted under 35 U.S.C. 154(b) by 0 days.

(21) Appl. No.: 09/924,729

(22) Filed: Aug. 8, 2001

Related U.S. Application Data

(63) Continuation of application No. 09/358,524, filed on Jul. 22, 1999.

(51) Int. Cl.[7] ..... A63B 57/00; A63B 69/36
(52) U.S. Cl. ..... 473/226
(58) Field of Search ..... 473/226, 257, 473/206, 215, 212

(56) References Cited

U.S. PATENT DOCUMENTS 4,095,797 A * 6/1978 Breese ..... 473/257
5,030,106 A * 7/1991 Cameron et al. ..... 439/8
5,117,815 A * 6/1992 Gentry et al. ..... 601/73
5,248,146 A * 9/1993 Viets et al. ..... 473/206
5,441,271 A * 8/1995 Briggs ..... 473/215

* cited by examiner

*Primary Examiner*—Paul T. Sewell
*Assistant Examiner*—M. Chambers
(74) *Attorney, Agent, or Firm*—Rankin, Hill, Porter & Clark LLP

(57) ABSTRACT

The present invention relates to a golf training device for use in teaching a golfer how to execute a proper golf swing, chipping stroke, and/or putting stroke using his or her own playing clubs. The golf training device according to the present invention includes a rod which defines a longitudinal axis and has first and second ends. A yoke assembly for engaging the and restraining the arms of a golfer is rotatably attached to the first end of the rod such that it is generally perpendicular to the longitudinal axis. A coupler for attaching to the grip end of a golf club is connected to the second end of the rod by a hinge having a pivot axis perpendicular to the longitudinal axis of the rod. In a preferred embodiment, the rod includes a top section and a bottom section which are rotatable relative to each other on the longitudinal axis. A golf training device according to the present invention maintains the arms of a golfer in the proper position throughout a golf swing and teaches the golfer to execute a golf swing and/or putting stroke having proper mechanics.

20 Claims, 7 Drawing Sheets

GOLF TRAINING DEVICE

CROSS REFERENCE TO RELATED APPLICATION

This is a continuation of application Ser. No. 09/358,524, filed Jul. 22, 1999.

BACKGROUND OF THE INVENTION

1. Field of Invention

The present invention relates to a golf training device, and more particularly to a golf training device for use in teaching a golfer how to properly execute a golf swing, chipping stroke, and/or putting stroke using the golfer's own playing clubs.

2. Background of the Invention

During a properly executed golf swing, the center of the relatively planar face of a golf club head moving at a relatively high velocity collides with a golf ball which is at rest on or near the ground. The force of the collision causes the golf ball to compress against the face of the club head, which itself may undergo some temporary deformation. Because the mass of the golf ball is significantly less than that of the moving golf club head, the collision causes the golf ball to become accelerated in the direction of the force being applied to it by the golf club head. The face of a golf club head is usually angled or tilted back a predetermined number of degrees from vertical and scored with horizontal grooves. The grooves in the face of the golf club engage the relatively soft cover of the golf ball during compression and prevent it from sliding up the face. As the golf ball decompresses and springs off of the face of the club, the grooves coupled with the tilt angle of the face of the golf club frictionally impart a backward spin and a rising trajectory to the golf ball. If the golf swing has been executed properly, the golf ball, which is usually dimpled to reduce drag and increase lift, will travel in a desired direction for a desired distance and come to rest again on the ground at the desired location known as the target, assuming of course that the flight of the ball is not affected by other forces, such as wind.

A golf ball is in contact with the face of a golf club for only a very short period of time during a golf swing. However, it is imperative that throughout this brief period of time the club face is maintained in a substantially perpendicular or square relationship to the target line if the ball is to travel in a straight path or trajectory along the target line. It is also imperative that the golf club head be traveling on a path which is in line with the target while it is in contact with the ball. In addition, it is important that the club head be moving at a relatively high rate of speed at the time of the collision with the ball in order to impart and transfer significant energy to the golf ball. Although there are many other factors at play in a golf swing, these are the three essential components of a properly executed golf swing.

If the golf swing is not executed properly, the golf ball will not travel on its intended course along the target line and land at the intended target. For example, if the spin axis of the golf ball is not substantially horizontal and perpendicular to the line to the intended target, the golf ball will tend to curve in flight to the right or to the left of the direction of the force applied by the club. For a right-handed golfer, a trajectory deviation to the right caused by an improper spin imparted to the golf ball is referred to as a "slice," and a trajectory deviation to the left caused by an improper spin imparted to the golf ball is referred to as a "hook." In addition, if the swing path of the club head at the point of impact with the golf ball is in a direction other than on the line to the intended target, the force transferred to the golf ball will cause it to become accelerated to the right or left of the target line, which for a right-handed golfer is called a "push" or "pull," respectively. These terms are reversed for a left-handed golfer. Other factors, such as the steepness or shallowness of the swing arc of the golf club, the velocity and acceleration of the golf club head at the moment of impact, the point on the face of the golf club which makes contact with the golf ball, and other factors can also have a significant affect on whether the golf ball comes to rest near its intended target.

Significant practice is required for a golfer to learn how to consistently execute a proper golf swing. Unfortunately, if during such practice the golfer learns poor swing mechanics or other bad habits resulting in swing flaws, such flaws can become "grooved" in the golfer's swing. In other words, the golfer's muscles become accustomed to executing a golf swing having one or more flaws or faults. A golfer who has grooved a swing with a flaw or fault has a very difficult time correcting the swing, primarily because such a golfer does not know what a proper swing is supposed to feel like or look like. Accordingly, rather than correcting the swing flaw, the golfer will more likely make a compensation in some other portion of the swing to adjust for the improper flight characteristics of the golf ball caused by the swing flaw. A classic example of this situation is a right-handed golfer with a swing flaw which produces a pronounced slice compensating for the slice by aiming far to the left of the intended target. Making compensations such as this may allow the golfer to hit the golf ball in the general direction of the intended target, but such compensations result in a loss of distance, accuracy, and consistency. Furthermore, it compounds the number of swing flaws and causes the golfer to groove an even worse swing. Thus, it is far better for a golfer who has grooved a swing with a flaw to re-learn and re-groove a proper golf swing which does not include swing flaws.

The prior art is replete with examples of devices which are intended to assist golfers in learning to execute various aspects of a proper golf swing. A recent example is the golfing aid disclosed in Brock et al., U.S. Pat. No. 5,846,143. The Brock et al. golfing aid includes a guide member attached to the shaft of a golf club which projects from the club and has a tip which contacts the leading forearm of the golfer at various points during a golf swing. The Brock et al. golfing aid is said to be useful in minimizing a swing flaw or fault described as "wrist cocking" by providing the golfer with instant feedback when the golfer's forearm makes contact with the tip. Unfortunately, the Brock et al. golfing aid is not useful for addressing many other common swing flaws, and is of no use in practicing a putting stroke.

Another prior art golf training device is disclosed in Potter et al., U.S. Pat. No. 5,842,808. The Potter et al. golf training device includes a practice golf club having a shaft incorporating an to adjustable spring-loaded hinge that "breaks" at the joint if the club is accelerated too quickly or jerked during the swing. While the Potter et al. golf training device is useful in teaching a golfer to execute a smooth or fluid swing, it is of very little utility in teaching the golfer to address other common swing flaws. Moreover, since the Potter et al. golf training aid is not attachable to the golfer's own clubs, a golfer using the Potter et al. golf training aid does not groove the feel of a properly executed swing using his or her own playing clubs.

Yet another prior art golf swing aid is disclosed in Armstrong, III, U.S. Pat. No. 5,294,126. The Armstrong, III golf swing aid includes a shaft with a grooved undersurface for engaging the shaft of a golf club and an extending tab for making contact with the golfer's forearm to indicate whether the golfer has proper cocking and uncocking of the wrists. In addition, the golf swing aid disclosed in Armstrong, III includes a curved portion which allows the golfer to pass his arms through and restrict them for practicing a putting stroke. This golf swing aid suffers from many of the same limitations as the Brock et al. golfing aid.

Yet another prior art golf training device is disclosed in Stawicki, U.S. Pat. No. 5,150,901. The Stawicki golf training device includes a harness assembly attachable to the upper torso of a golfer and has an elongated golf club swing guiding member swively coupled to the harness assembly and the shaft of the golf club respectively. The Stawicki golf training device is said to prevent a right-handed golfer from bending his left elbow during a golf swing. Unfortunately, the Stawicki golf training device is not useful for addressing many other common swing flaws.

It will be appreciated that while prior art golf training aids may be useful in addressing and correcting one or more golf swing flaws, none of them are effective in teaching a golfer the feel of all aspects of a properly executed golf swing. Thus, they are of limited utility. A golf training device is needed that can be temporarily attached to any of a golfer's own playing clubs, including the putter, and can be used to provide the golfer with the look, sound, and feel of all aspects of a properly executed golf swing, chipping stroke, and/or putting stroke.

SUMMARY OF THE INVENTION

The present invention provides a new and useful golf training device for use in teaching a golfer how to execute a proper golf swing, chipping stroke, and/or putting stroke using his or her own playing clubs. The golf training device according to the present invention is adapted to attach to the grip end of a golf club and engage the arms of a golfer. In the preferred embodiment, the golf training device includes a rod of adjustable length to which is rotatably attached at one end a yoke assembly for engaging and restraining the arms of a golfer. The other end of the adjustable rod is connected by a hinge to a coupler which preferably clamps onto the grip end of a golf club. In a preferred embodiment, the rod includes a top section and a bottom section which are rotatable relative to each other on the same longitudinal axis.

To use the golf training device according to the present invention to practice a golf swing, a golfer attaches the coupler to the grip end of a golf club in a manner so as to fix the pivot axis of the hinge generally perpendicular to the leading edge of the face of the club. The golfer passes his or her arms through the yoke assembly and takes a comfortable grip on the uncovered portion of the grip of the golf club. In a preferred embodiment, the yoke assembly comprises two arm restrainers which are preferably formed of a resilient material which comfortably restrains the motion of the golfer's arms and maintains them in proper relation to the golf club during the swing. The golfer's arms and an imaginary line running between the golfer's shoulders form a triangle which the golf training device of the present invention controls the movement of during practice.

The golf training device according to the present invention is useful for providing the golfer with the look, sound, and feel of a properly executed golf swing. As a golfer using the device takes the golf club away from the golf ball at the address position and begins the back swing, the rod prevents the golfer from bending his or her wrists in an improper manner and the yoke assembly provides resistance to the golfer's arms if he or she attempts to bend the elbows or separate the arms in an improper manner. The golf training device according to the present invention forces the golfer to keep the golf club in the proper square relationship with respect to the golfer's body (i.e., generally perpendicular to the golfer's spine) and in the proper swing plane during the back swing. At the top of the back swing, the hinge connecting the lower portion of the rod to the coupler allows the golfer to properly cock his or her wrists in the appropriate plane. The yoke assembly continues to restrain the golfer's arms and keeps them in the correct position by causing the triangle formed by the golfer's arms and the imaginary line between the golfer's shoulders to rotate on the back swing. As the golfer completes the back swing, the golf training device causes the golfer to make a full shoulder turn such that his or her back is facing the target. As the golfer begins the swing, the golf training device forces the golfer to keep the golf club in the proper swing plane at all times. At the point of impact, the golf training device keeps the golfer's arms and the golf club in the proper relationship with the face of the club being maintained substantially perpendicular or square to the intended target line. As the golfer follows through after impact with the golf ball, the golf training device maintains the arms in a proper relationship causing the golfer to complete the shoulder turn and finish the swing fully facing the target. Any previously undiagnosed flaws present in the golfer's swing become instantly apparent to the golfer as he or she attempts to resist the restraints or force the golf training device to rotate on an improper axis. The golf training device teaches the golfer to make a symmetrical back-swing and follow-through.

The golf training device according to the present invention is fully adjustable, and can be attached to any of the golfer's actual playing clubs, including the putter. When used on the putter, the device is simply turned over 180° on the longitudinal axis and the rotational movement of the top section of the rod relative to the bottom section of the rod is arrested, preferably by a locking pin. The hinge between the coupler and the lower portion of the rod includes a stop which prohibits movement of the coupler relative to the rod in the upward direction. The golfer passes his or her arms through the yoke assembly and takes a comfortable grip predominantly on the uncovered portion of the putter grip. The golf training device causes the golfer's arms and putter to be maintained in a fixed relationship relative to each other which forces the golfer to properly execute the putting stroke using the upper body/shoulder area, and not using the wrists or hands.

Thus, the golf training device according to the present invention maintains the golfer's arms in a correct position relative to the golf club and forces the golfer to execute a swing or putt having proper mechanics. Preferably, a golfer uses the golf training device according to the present invention while receiving golf instruction from a trained golf professional who can help the golfer identify and correct swing flaws. After executing repeated golf swings and putting stokes with the golf training device attached to his or her clubs, the golfer's muscles will become accustomed to the feel of a properly executed golf swing and/or putt, and the golfer will know what a properly executed golf swing and/or putt should look and sound like. Through repeated use of the golf training device according to the present invention, the golfer will groove a golf swing which has no flaws or faults. Unlike many of the prior art golf training devices, the golf training device according to the present invention allows the golfer to strike and putt golf balls using the golfer's actual playing clubs during practice which gives the golfer the ability to feel, see, and hear how a properly struck, chipped, and/or putted golf ball reacts.

These and other advantages are provided by the present invention of a golf training device adapted to attach to the grip end of a golf club and engage the arms of a golfer, the golf training device comprising: a rod defining a longitudinal axis and having first and second ends; a yoke rotatably connected at the first end of the rod, the yoke comprising a pair of opposing arm restrainers for engaging the arms of a golfer and maintaining the arms in a predetermined relationship with respect to each other and the rod; a coupler for attachment to the grip end of the golf club; and a hinge connecting the coupler to the second end of the rod, the hinge having a pivot axis being disposed perpendicular to the longitudinal axis.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE PREFERRED EMBODIMENT

Figure 1:
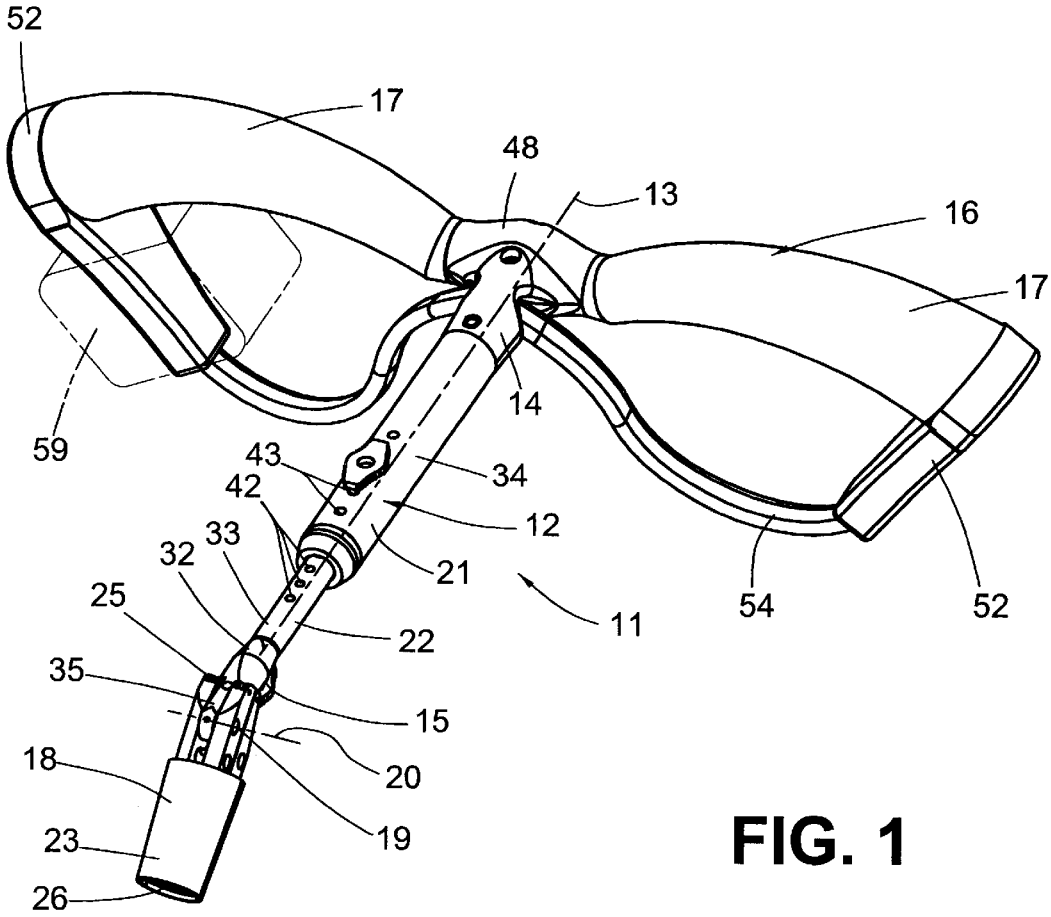
FIG. 1 is a perspective view of one preferred embodiment of the invention.

With reference to FIG. 1, a golf training device 11 according to the present invention comprises a rod 12 defining a longitudinal axis 13 and having first end 14 and a second end 15. A yoke assembly 16 is rotatably connected, preferably at the midpoint of its length, to the first end 14 of the rod 12 such that the axis of rotation is generally perpendicular to the longitudinal axis 13. The yoke assembly 16 should also be disposed generally perpendicular to the longitudinal axis 13. The yoke assembly 16 comprises a pair of opposing arm restrainers 17 for engaging the arms of a golfer and maintaining them in a predetermined relationship with respect to each other and the rod 12. A coupler 18 for attachment to the grip end of a golf club is connected to the second end 15 of the rod 12 by a hinge 19. The hinge 19 has a pivot axis 20 which is disposed perpendicular to the longitudinal axis 13 defined by the rod 12. Preferably, the pivot axis 20 is disposed such that it is near the center line of a right-handed golfer's left wrist (reversed for a left-handed golfer) when the device is being used. This location of the pivot axis 20 ensures that the golfer's wrist maintained is in the correct position throughout the swing.

In a preferred embodiment, the rod 12 comprises an upper portion 21 terminating in the first end 14 and a lower portion 22 terminating in the second end 15, with the upper portion 21 and the lower portion 22 being rotatably connected to permit rotation relative to each other on the longitudinal axis 13. More preferably, the rotation of the upper portion 21 relative to the lower portion 22 can be selectively restricted to permit the golfer to practice various individual components of a proper golf swing. In the preferred embodiment, the length of the rod 12 along the longitudinal axis 13 is adjustable. Each of the individual essential components which comprise the golf training device 11 according to the present invention are described in greater detail below.

The Coupler

Figure 2:
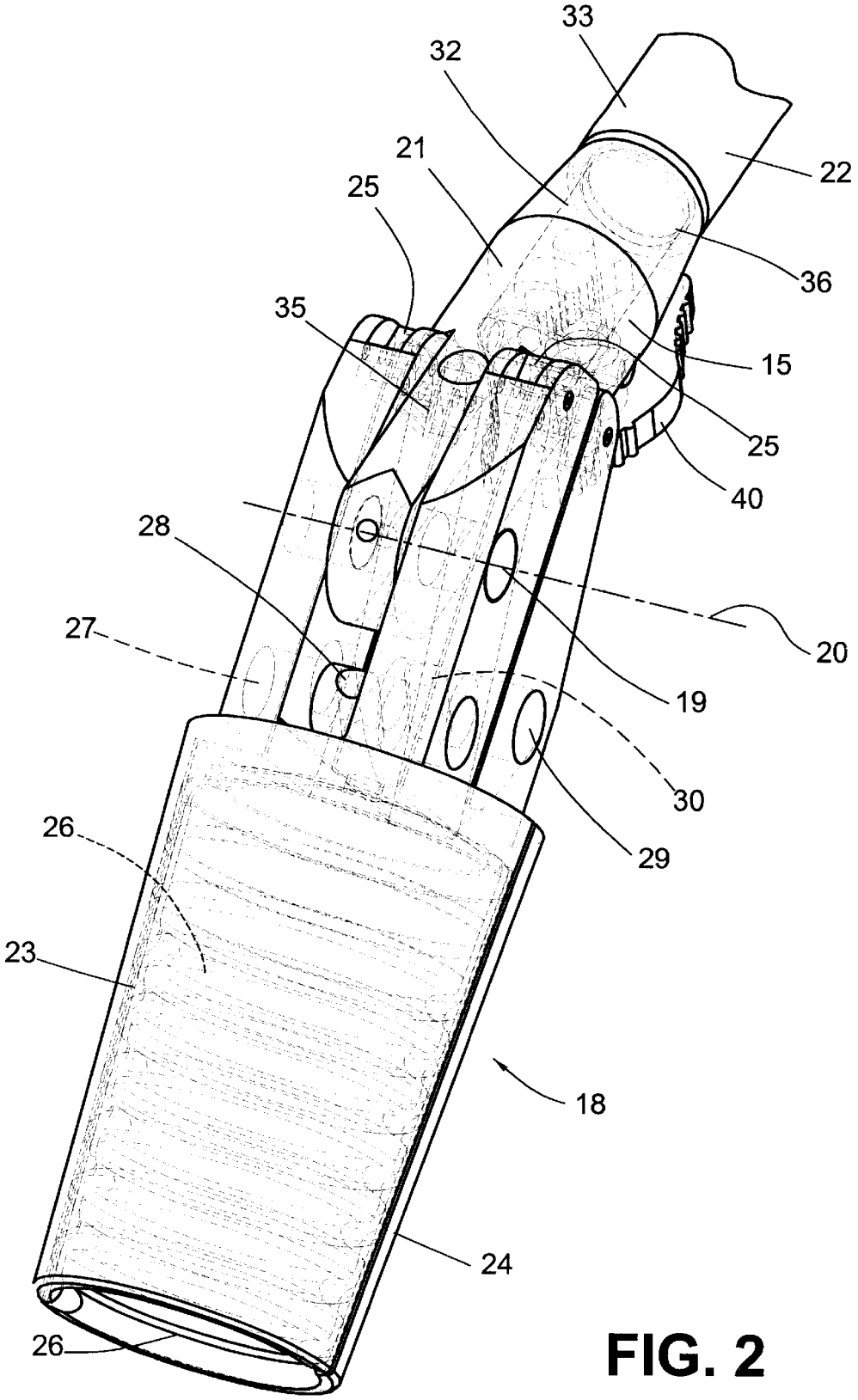
FIG. 2 is a detailed perspective view of a portion of FIG. 1.
Figure 3:
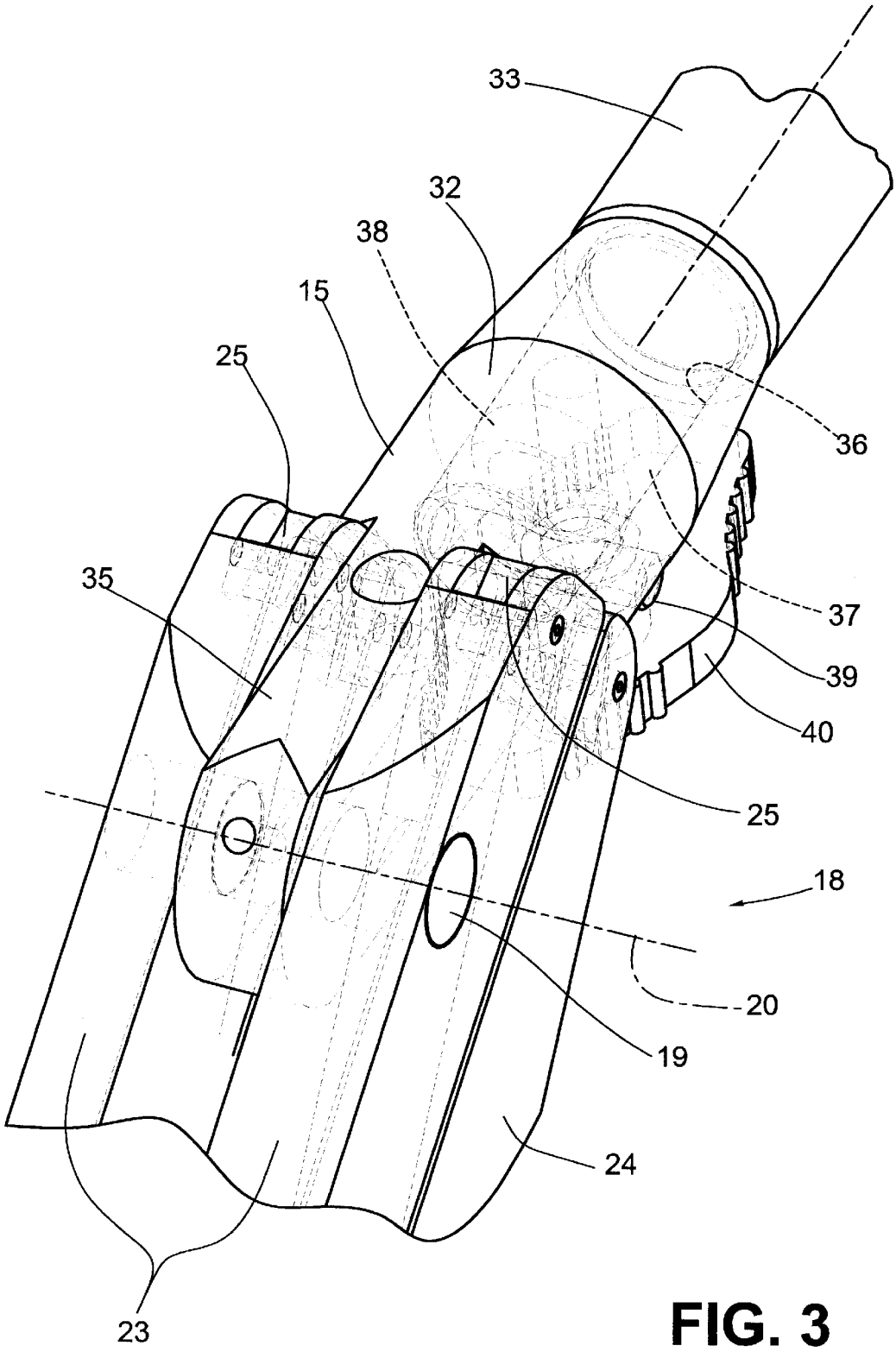
FIG. 3 is a detailed perspective view of another portion of FIG. 1.

With particular reference to FIG. 2 and FIG. 3, in the most preferred embodiment, the coupler. 18 of the golf training device 11 according to the present invention comprises an upper jaw 23 and a lower jaw 24 which are each separately connected on one end to a pair of opposing hinge plates 25 to form an alligator clamp assembly that is capable of clamping onto the grip end of golf clubs of all conventional sizes. The space between the opposing hinge plates 25 defines a slot. The interior portion of the ends of the upper jaw 23 and the lower jaw 24 opposite the hinge plates 25 are preferably provided with ridges 26 which are oriented so as to frictionally engage the grip end of a golf club when the upper jaw 23 and the lower jaw 24 of the alligator clamp assembly are pressed toward each other. The ridges 26 act as blunt teeth which bite into but do not damage the resilient materials from which the grips of golf clubs are commonly formed, such as leather and rubber. Preferably, the upper jaw 23 and lower jaw 24 can frictionally engage no more than about the last 2 inches of the grip end of a golf club, leaving a substantial portion thereof available for the golfer to grip when using the device. As shown in FIG. 2, the ridges 26 are provided at the open end of the jaws 23 and 24, but are not provided along the entire interior length of the jaws so that more room is provided away from the opening for the club grip material. The upper jaw 23 and lower jaw 24 are preferably formed from rigid plastic or aircraft aluminum and have a slim profile so as to permit the golfer to take a comfortable grip on the golf club when using the device, even if part of the grip is taken over a portion of the jaws.

In the illustrated embodiment shown in FIG. 2, the upper jaw 23 is provided with an upper pin 27 which is bisected at its midpoint by a threaded bore 28. The lower jaw 24 is provided with a lower pin 29 which is bisected at its midpoint by a smooth bore 30 which is slightly larger in diameter than the threaded bore 28. The threaded end of a clamping pin 31 (see FIG. 6) passes through the smooth bore 30 and engages the threaded bore 28. When the threaded end of the clamping pin 31 is screwed into the threaded bore 28, the head of the clamping pin 31 presses against the lower jaw 24 which causes the upper jaw 23 and the lower jaw 24 of the alligator clamp assembly to become pressed toward each other and securely attach the coupler 18 to the grip end of a golf club.

It will be appreciated that the preferred configuration of the coupler 18 describe above is but one possible configuration which would be suitable for use in the invention and that other configurations for the coupler 18 can be used. For example, the coupler 18 could comprise a socket formed of a resilient material which slides over and frictionally engages the grip end of a golf club. Alternatively, the coupler 18 could comprise a rigid collar sized to easily slide over the grip end of a golf club and be attachable thereto using threaded fasteners which press against the grip end of the golf club as they are tightened. Essentially, any configuration which includes means for securely attaching the coupler 18 to the grip end of a golf club and a source for permitting the coupler 18 to be connected to the second end 15 of the rod 12 by a hinge 19 would be suitable.

The Rod

Figure 4:
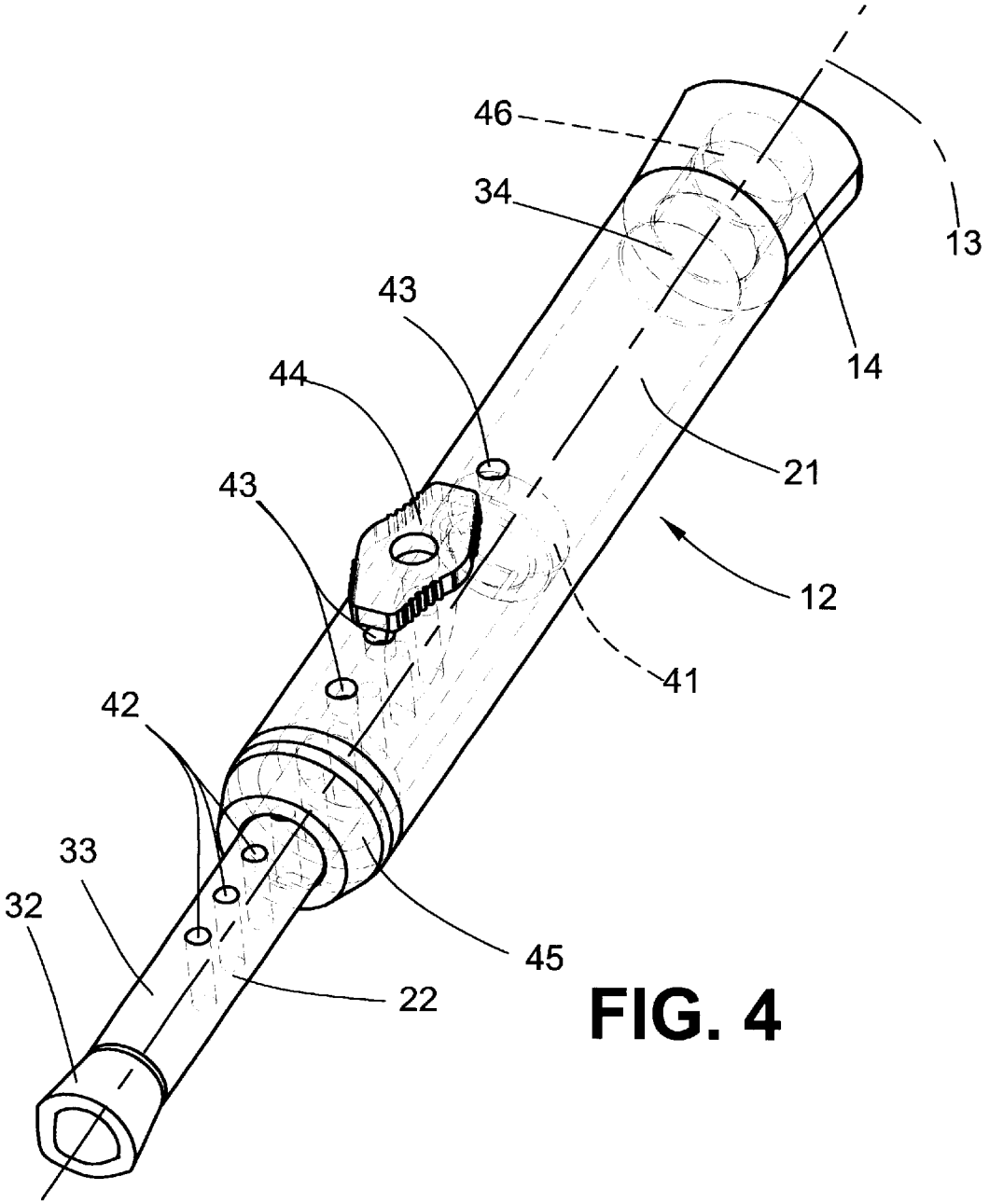
FIG. 4 is a detailed perspective view of yet another portion of FIG. 1.

With particular reference to FIG. 4, in the most preferred embodiment, the rod 12 comprises several sub-components which cooperate to make the rod 12 adjustable in terms of its length on the longitudinal axis 13 and provide for selective range of motion about the pivot axis 20 as well as selective range of rotation of the upper portion 21 relative to the lower portion 22 on the longitudinal axis 13. In the embodiment illustrated in FIG. 1, the rod 12 is comprised of three sub-components: a bottom section 32 terminating in the second end 15; a middle section 33; and a top section 34 terminating in the first end 14. The cooperation of the various sub-components that comprise the rod 12 are discussed below.

Figure 6:
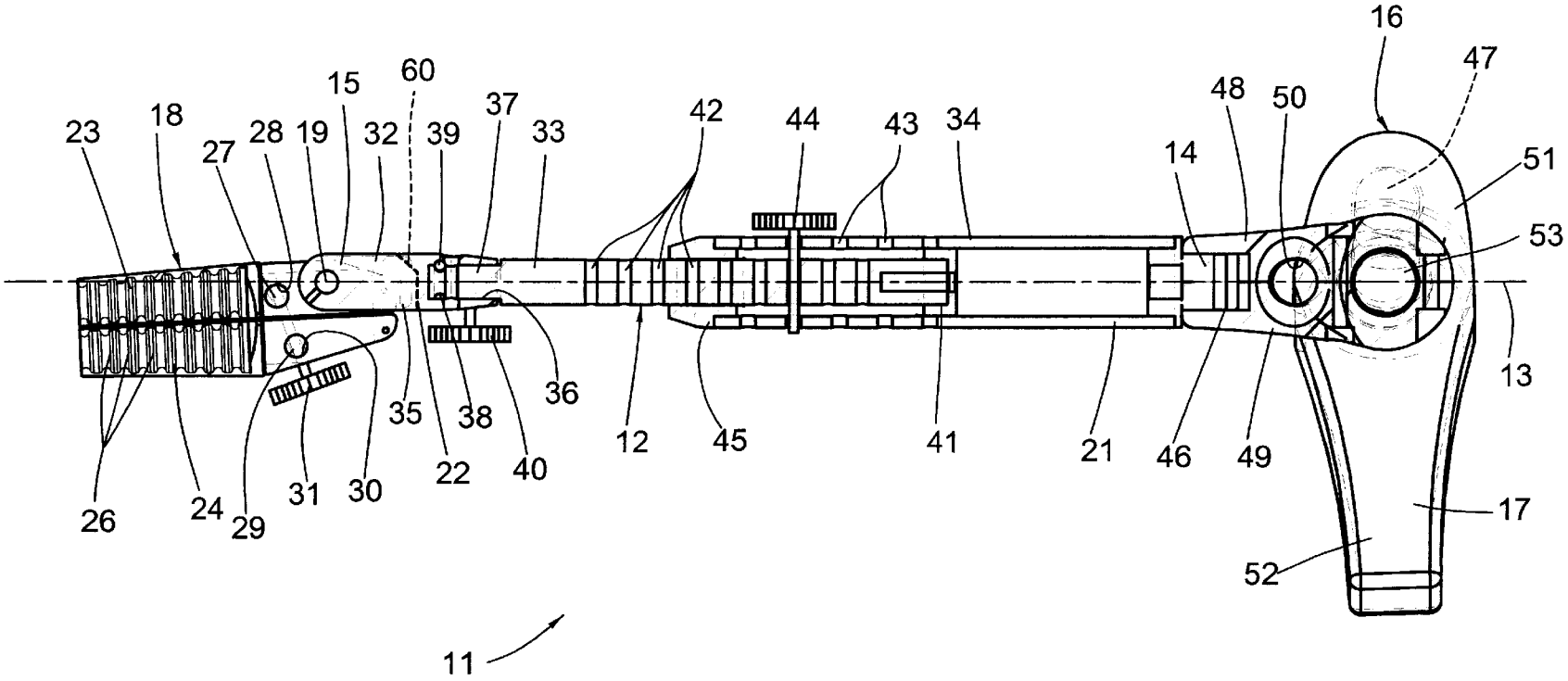
FIG. 6 is a side elevation view of the preferred embodiment of the invention shown in FIG. 1.

As can be seen in greater detail in FIG. 2, FIG. 3, and FIG. 6, the portion of the bottom section 32 which terminates in the second end 15 includes a tongue portion 35 which fits into the slot defined by the space between the opposing hinge plates 25 in the coupler 18. The tongue portion 35 is connected to the coupler 18 by a hinge 19 having a pivot axis 20 which is perpendicular to the longitudinal axis 13 of the rod 12. The opposite end of the bottom section 32 includes a cylindrical bore 36 along the longitudinal axis 13.

One end of the middle section 33 terminates in a cylindrical post 37 which is provided with a circumferential race 38, which may also be referred to as a channel or a groove. The post 37 slides into the cylindrical bore 36 in the bottom section 32. A clevis 39 passes through an opening in the bottom section 32 so as to engage the race 38 and prohibit the removal of the post 37 from the cylindrical bore 36 in the bottom section 32 while permitting the bottom section 32 to rotate on the longitudinal axis relative to the middle section 33. A locking pin 40 can be selectively inserted into an opening through the bottom section 32 and the post 37 to restrict rotation of the bottom section 32 relative to the middle section 33 when desired. Attached to the end of the middle section 33 opposite the post 37 is a bushing 41. The middle section 33 is provided with a plurality of length adjustment holes 42 which are perpendicular to and bisect the longitudinal axis 13.

The top section 34, which is illustrated in detail in FIG. 4 and FIG. 6, comprises a tube which is open on one end and closed on the other end. The middle section 33 slides into the open end of the top section 34 and rides on the interior walls on the bushing 41. The top section is provided with a plurality of openings 43 which can be aligned with the length adjustment holes 42 in the middle section 33. The length of the rod 12 along the longitudinal axis 13 can be adjusted by sliding the middle section 33 relative to the top section 34 until the desired length is obtained and then passing a length adjustment pin 44 through an aligned set of openings 43 and length adjustment holes 42. Preferably, the orientation of the middle section 33 within the top section 34 is maintained by a threaded collar piece 45 which attaches to the open end of the top section 34. The threaded collar piece 45 also prevents the middle section 33 from being withdrawn from the top section 34. The closed end of the top section 34 terminates in the first end 14. In the illustrated embodiment, the first end 14 comprises a ribbed finger section 46. Preferably, the entire rod 12 is constructed of aircraft aluminum except for the bushing 41 and the collar 45, which are preferably constructed of brass. However, the rod 12 could be constructed of virtually any rigid material.

It will be appreciated that there are a multitude of possible configurations for the rod 12 which would be suitable for the invention. For example, the rod 12 need not be linear in configuration, but could include some degree of curvature. If the rod 12 does include curvature, the longitudinal axis would be defined as the line running from the first end 14 to the second end 15. Additionally, it will be appreciated that the functionality of the rod 12 could be accomplished using configurations featuring components other than illustrated in the preferred embodiment. For example, the length of the rod 12 could be adjusted using a lockable screw-jacking mechanism rather than by passing a length adjustment pin 44 through aligned openings 43 and length adjustment holes 42. Alternatively, the length of the rod 12 could be adjusted by using telescoping tubes and a compression fitting. Moreover, the rotation of the upper portion 21 relative to the lower portion 22 could be accomplished by means other than by a race 38 and clevis 39. Moreover, extension pieces could be added to extend the length of the rod 12. Alternatively, the shaft and post could be configured such that the length of the rod is adjustable over a greater distance, with the intent being to permit the yoke assembly to ride higher on the golfer's arms and closer to the golfer's shoulders. Essentially, any configuration of the rod 12 which included means for connecting the second end 15 of the rod 12 to the coupler 18 using a hinge 19 having a pivot axis 20 which was perpendicular to the longitudinal axis 13 and which allowed the first end 14 of the rod 12 to be connected to the yoke assembly 16 would be suitable.

The Yoke Assembly

Figure 5:
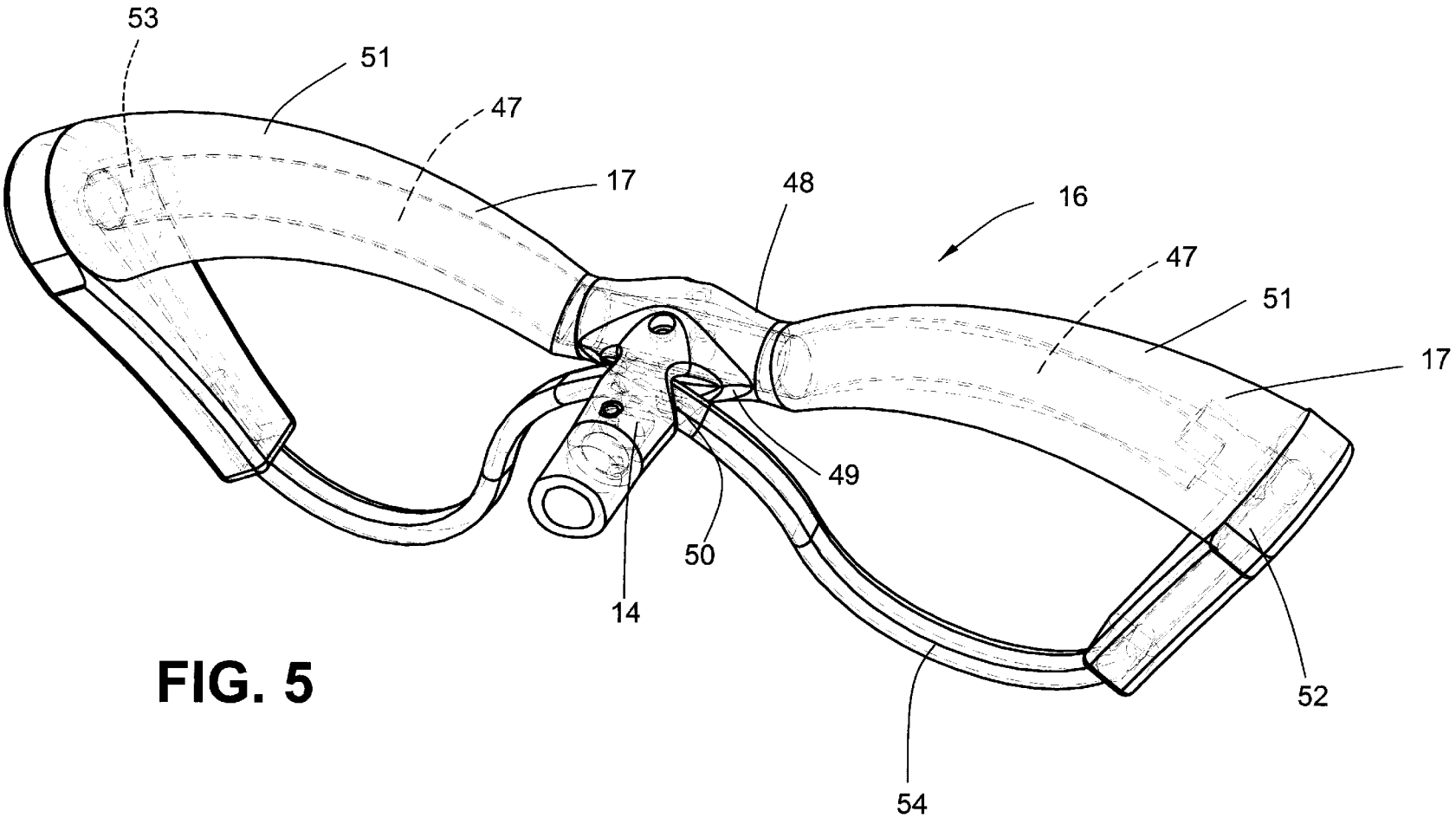
FIG. 5 is a detailed perspective view of yet another portion of FIG. 1.

With particular reference to FIG. 1, FIG. 5, and FIG. 6, in a preferred embodiment, the yoke assembly 16 is rotatably connected, preferably at the midpoint of its length, to the first end 14 of the rod 12 such that the axis of rotation of the yoke assembly 16 is generally perpendicular to the longitudinal axis 13. The yoke assembly 16 also should be disposed generally perpendicular to the longitudinal axis 13. In the illustrated embodiment, the yoke assembly 16 is formed from several sub-components which cooperate to form the pair of opposing arm restrainers 17 which comfortably engage and restrain the arms of a golfer using the device and maintaining them in a predetermined relationship with respect to each other and the rod 12.

With particular reference to FIG. 5 and FIG. 6, a tubular arm bar 47 is rotatably connected in a substantially perpendicular orientation to the longitudinal axis 13 of the rod 12 by a top T-clam shell 48 and a bottom T-clam shell 49 which cooperate to fixedly clamp onto the ribbed finger section 46 of first end 14 of the rod 12 and rotatably clamp onto the midpoint of the tubular arm bar 47. The tubular arm bar 47 can have a straight profile, but preferably has a gentle arcuate profile to comfortably engage the top portion of a golfer's arms. The top T-clam shell 48 and bottom T-clam shell 49 also cooperate to define a passage 50 between the end of the rod 12 and the tubular arm bar 47. Preferably, the passage 50 is parallel to the tubular arm bar 47. A pair of opposing arm bar pads 51 formed of a resilient material cover that portion of the tubular arm bar 47 which is not rotatably clamped within the top T-clam shell 48 and bottom T-clam shell 49. A pair of opposing horns 52 are connected at their proximal ends to each end of the tubular arm bar 47. The opposing horns 52 are preferably formed of a resilient material and include horn posts 53 which fit into and engage the open ends of the tubular arm bar 47. An elastic strap 54 is attached to the distal end of one opposing horn 52, passes through the passage 50, and is attached to the distal end of the other opposing horn 52. The elastic strap 54 serves the dual purpose of gently holding the golfer's arms within the arm restrainers and also of providing resistance to discourage rotation of the yoke assembly through a range of greater than about 180°. Preferably, the arm bar pads 51, the opposing horns 52, and the elastic strap 54 are encased within a snug-fitting protective fabric material, such a fabric formed from Spandex® fibers. It will be appreciated that the yoke assembly 16 must be smooth enough to allow for some movement of the device relative to the golfer's arms during the golf swing, but be secure enough to provide sufficient resistance such that the golfer's arms do not get out of the proper position during the swing.

It will be appreciated that there are a multitude of potentially suitable configurations for the yoke assembly 16. For example, the arm bar 47 could be solid rather than tubular. The arm bar 47 could have a relatively flat cross-section rather than a round cross-section. The arm bar 47 could extend and curve in such a manner so as to make the opposing horns 52, elastic strap 54, and passage 50 unnecessary. Essentially, any configuration which permits the yoke assembly 16 to be maintained in an orientation which is substantially perpendicular to the longitudinal axis 13 and which includes means to restrain the movement of the golfer's arms so as to keep them in the proper relationship with the golf club during a swing would be suitable.

Preferred Methods of Use

Figure 7:
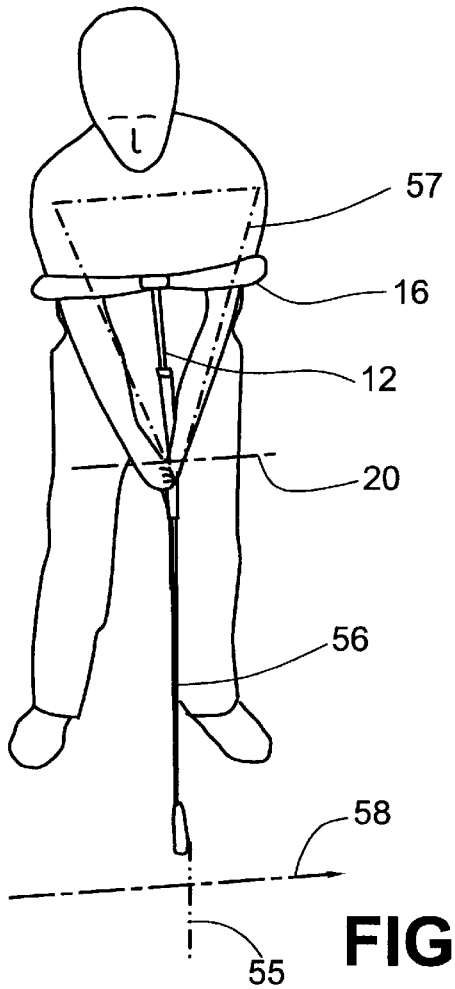
FIG. 7 is a perspective view of one preferred embodiment of the invention in use.
Figure 8:
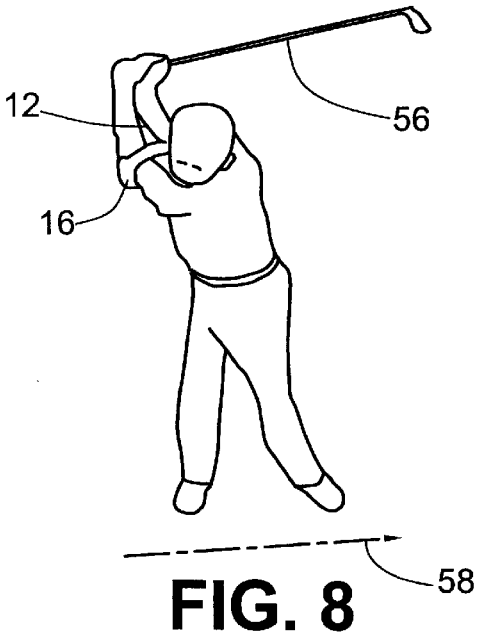
FIG. 8 is another perspective view of one preferred embodiment of the invention in use.
Figure 9:
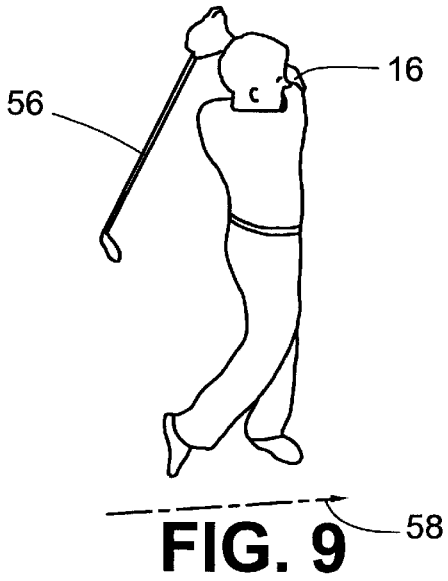
FIG. 9 is yet another perspective view of one preferred embodiment of the invention in use.

With reference to FIG. 7, FIG. 8, and FIG. 9, to use the golf training device according to the present invention to practice a golf swing, whether actually striking a golf ball or not, a golfer attaches the coupler 18 to the grip end of a golf club in a manner so as to fix the pivot axis 20 of the hinge 19 generally perpendicular to the leading edge 55 of the face of the club 56. The golf training device can preferably include indicia which helps the golfer properly fix the orientation of the leading edge of the golf club relative to the pivot axis of the hinge. It will be appreciated that golfers who have mastered the basic golf swing may vary the fixed relationship between the pivot axis 20 of the hinge 19 and the leading edge of the face of the golf club in order to practice special shots, such as fades or draws, where the rotation of the golf ball relative to the target line 58 is intentionally altered from perpendicular. In either event, the golfer passes his or her arms through the yoke assembly 16 and takes a comfortable grip predominantly on the uncovered portion of the grip of the golf club. Because the profile of the coupler 18 is relatively slim, a portion of the golfer's grip may be on the coupler 18. The golfer assumes an address position behind a golf ball or other practice aid, such as a golf tee (FIG. 7). While in the address position, the hinge 19 permits the golfer to raise and lower the golf club and thereby change the lie angle between the bottom of the club head and the ground to suit the golfer's stance. Once a comfortable stance has been obtained, the golfer begins the back swing by turning the shoulders which moves the golf club away from the golf ball on the line from the target through the golf ball (FIG. 8). This part of the back-swing is called the take away. One of the common swing flaws encountered by golfers is that the take away is executed by the golfer lifting the head of the golf club off the ground by using the arm muscles and by bending the joints of the wrist and/or elbow. The rod 12 coupled with the hinge 19 having a pivot axis 20 generally perpendicular to the leading edge of the face of the golf club prevents the golfer from executing a take away by using the arm muscles and by bending the joints of the wrist and/or elbow. Instead, the golfer learns to execute a take away that involves rotating the trunk of the body about the golfer's spine. This is called a shoulder turn.

As the golfer continues to execute the back swing and complete the shoulder turn, the rod 12 and arm restrainers 17 operate to keep the golfer's arms moving together in the proper position relative to one another. Another common swing flaw involves a separation of the golfer's elbows during the back swing. Yet another common swing flaw involves the bending of the elbows, particularly the left elbow for a right handed golfer, which gets the golf club in an improper position. The arm restrainers 17 keep the golfer's arms in the proper relationship to each other and the golf club, the arms and an imaginary line running between the golfer's shoulders forming a triangle 57 (FIG. 7) that is maintained throughout the swing. The rod 12 keeps the golfer from bending the elbows in an improper manner. As the golfer approaches the top of the back swing (FIG. 8), the triangle formed by the golfer's arms and the imaginary line running between the golfer's shoulders will rotate, with the hinge 19 eventually allowing the golfer to cock his or her wrists in the appropriate plane at the appropriate point in the swing. If the golfer using the device has sufficient flexibility, at the top of the back swing the golf club will be oriented such that the shaft is generally parallel to the target line 58. Golfers with lesser flexibility may not achieve this position at the top of the back swing. The left elbow joint, for a right-handed golfer, will be higher than the right elbow joint at the top of the back-swing. This is the correct position that comes about as the golf training device according to the present invention causes the triangle formed by the golfer's arms and the imaginary line between the golfer's shoulders to rotate during the back swing.

From the top of the back swing, the golfer begins to swing the golf club toward the golf ball. The golfer's body, which has previously executed a turn in order to complete the back swing (preferably 90° at the shoulders and 45° at the waist from the address position), turns back toward the ball as the golfer's arms move back toward the initial address position. Centrifugal force generated by the arms and the golf club swinging on an axis defined by the golfer's spine causes the golf club head to accelerate on the arc of the swing path and pulls the golf club head away from the golfer's body. The golf training device 11 according to the present invention creates a centripetal force which holds the golf club head toward the golfer's body and keeps the path of the club head along the target line 58 as the club head is in contact with the golf ball. As the golf club head moves from a position at the top of the back swing that parallels the target line 58 (see FIG. 8) to a position at the bottom of the swing that is perpendicular to the target line (see FIG. 7), the golf training device according to the present invention causes a rapid acceleration in club head speed as the angle created by the coupler 18 and the rod 12 rotates on the longitudinal axis 13. Centrifugal force creates this momentum and the golf training device according to the present invention provides a centripetal force which keeps the club head from being pulled away from the golfer's body, while it insures that the face of the golf club is maintained in a relatively square position relative to the target line 58. Because the rod 12 and hinge 19 only permit the golf club to be moved on the proper axis, the leading edge of the face of the golf club will be kept square or perpendicular to the target line 58 while the face of the golf club head is in contact with the golf ball.

As the golfer continues the swing, the golf ball springs off the face of the club head and flies toward the target. The golfer will instantaneously see, hear, and feel what a properly struck golf ball looks, sounds, and feels like. The golfer finishes the swing in a move called the follow-through (FIG. 9). As with the back swing, the golf training device 11 according to the present invention forces the golfer to keep his or her arms in the proper position relative to the golf club and also forces the golfer to execute a full shoulder turn toward the target.

It will be appreciated that the golf training device according to the present invention can be used with any of the golfer's actual playing clubs, including the putter as more fully discussed below. Moreover, the golf training device can be attached to other training aids, such as weighted half-shafts and other objects. Moreover, the golf training device can be used to practice chipping and pitching, sand shots, and golf shots that require less than a fill swing.

Another common swing flaw which can be corrected by using the golf training device 11 according to the present invention involves the shallowness or the steepness of the plane in which the golf swing is executed. Optional spacers 59 (see FIG. 1) can be placed between the golfer's arms and one of the opposing horns 52 so as to shift the center of the yoke assembly 16 slightly to the golfer's left or right. For a right-handed golfer, placing a spacer 59 between the horn 52 adjacent to the golfer's left arm encourages the golfer to execute the golf swing in steeper swing plane. On the contrary, placing a spacer 59 between the horn 52 adjacent to the golfer's right arm encourages the golfer to execute the golf swing in a shallower swing plane. Modification of the swing plane can affect the trajectory and flight characteristics of a golf ball.

The golf training device 11 according to the present invention preferably includes a rod 12 of adjustable length. By adjusting the length of the rod 12, the golfer can vary the point on the golfer's arms (i.e., from the lower forearms to the upper arms) at which contact is made with the arm restrainers 17 of the yoke assembly 16. This allows the golfer to feel where his or her arms should be during a properly executed golf swing. Any previously undiagnosed flaws present in the golfer's swing become instantly apparent to the golfer as he or she attempts to fight the arm restraints 17 or to force the golf training device 11 to try to rotate on an improper axis.

In a preferred embodiment, the rod 12 includes an upper portion 21 which can rotate on the longitudinal axis 13 relative to the lower portion 22. By permitting the rotation along the longitudinal axis 13, the golfer can learn to roll his or her wrists in conjunction with a proper shoulder turn as the club face strikes the golf ball during the swing. Once learned, this technique allows the golfer to hit a golf ball farther and with greater force than a swing without a wrist roll. For those golfers who are just beginning to learn how to execute a golf swing or who are correcting a previously grooved swing flaw, a locking pin 40 can preferably be used to restrict rotation of the upper portion 21 of the rod 12 relative to the lower portion 22 until a swing with proper mechanics is learned and grooved. In other words, the golf training device of the present invention allows the golfer to isolate various aspects of the swing in order to address certain swing flaws during practice.

The golf training device 11 is intended to involve as many of the golfer's senses as possible. The golf training device 11 provides a visual reference for the golfer to see where his or her arms, body, and golf club should be during a properly executed golf swing. Additionally, the golf training device 11 involves the golfer's sense of touch by allowing the golfer to feel the grips of his or her own actual playing golf clubs as well as the contact between the golfer's arms and the yoke assembly 16. Moreover, the golfer can feel and hear what a properly struck golf ball is supposed to feel and sound like. In a preferred embodiment, the hinge 19 also includes a spring-loaded detent which provides an audible click when the hinge pivots on its axis during the swing. If the golf swing is being executed properly, the click of the detent will be heard when the golfer's arms are in the same position each time. Finally, in order to relax the golfer during practice, the resilient material from which the arm bar pads 51 and opposing horns 52 are formed can be scented with a soothing composition, such as lavender.

It will be appreciated that the golf training device 11 according to the present invention can be attached to any of the golfer's playing actual playing clubs. Thus, a golfer can practice a golf swing and hit golf balls as noted above with each and every playing club, from a driver to a sand wedge. The device can be used to practice full swings to pitch shots and chip shots. In addition, the golf training device according to the present invention can be attached to the golfer's putter, weighted rods, half-shafts, or other golf training aids.

The golf training device 11 according to the present invention can also be used to teach a golfer how to properly execute a putting stroke. When used on the putter, the golf training device 11 is simply turned over 180° on longitudinal axis 13 such that the lower jaw 24 is facing upward. The golfer attaches the coupler 18 to the grip end of the putter such that the leading edge of the blade of the putter is generally perpendicular to the pivot axis of the hinge 19. With reference to FIG. 6, in a preferred embodiment the bottom section 32 of the rod 12 preferably includes a stop 60 which limits the rotation of the coupler 18 relative to the rod 12 on the pivot axis 20 past a few degrees, preferably no more than about 30°, beyond parallel (i.e., in the opposite direction of the pivot when using the golf training device to practice full swings). In addition, when the golf training device 11 is used on the putter, a locking pin 40 is preferable engaged such that there is no rotation of the upper portion 21 of the rod 12 relative to the lower portion 22. The yoke assembly 16 rotates approximately 180° via rotation of the tubular arm bar 47 through the top T-clam shell 48 and bottom T-clam shell 49. The golfer passes his or her arms through the yoke assembly 16 and takes a comfortable grip predominantly on the uncovered portion of the grip of the putter. The golfer's grip may also cover a portion of the coupler 18.

When the golf training device according to the present invention is used on a putter, the pivot axis 20 is shifted to a different position relative to the golfer's wrists when the golfer is holding the club. This position firmly fixes the club and prevents any wrist movement or cocking in the putting stroke. The putter and rod 12 become a fixed unit which can only be moved using the golfer's upper body/shoulder muscles. The golfer's upper arms are kept in the proper relationship by the yoke assembly 16, and the stop 60 keeps the putter shaft at the proper angle, preferably no more than 30° from parallel, from the longitudinal axis 13.

The golf training device 11 according to the present invention keeps the blade of the putter square or perpendicular to the line from the golf ball to the target. In addition, the yoke assembly 16 and the rod 12 prohibit the golfer from executing the putt using the muscles of the arms and the joints of the wrist and/or elbows. Instead, the golf training device 11 forces the golfer to execute the putting stroke using the muscles of the upper body and shoulders, which is far more accurate and consistent. Generally speaking, length of the rod 12 can be adjusted such that the arm restrainers 17 contact the upper arms at the biceps of the golfer when practicing the putting stroke. By adjusting the length of the rod 12, it is possible to move the yoke assembly higher on the golfer's arms nearer the shoulders. The higher the golf training device rides on the golfer's arms, the more compact the arm position becomes because the horns 52 press inward on the golfer's arms, and thus a more pronounced shoulder turn can be felt by the golfer during putting practice.

The golf training device 11 according to the present invention maintains the golfer's arms in a correct position relative to the golf club and forces the golfer to execute a swing or putt having proper mechanics. Preferably, a golfer uses the golf training device according to the present invention while receiving golf instruction from a trained golf professional who can help the golfer identify and make suggestions to the golfer regarding methods to correct various swing flaws. After executing repeated golf swings and putting stokes with the golf training device 11 attached to his or her clubs, the golfer's muscles will become accustomed to the feel of a properly executed golf swing and/or putt. Through repeated use of the golf training device according to the present invention, the golfer will groove a golf swing which has no flaws or faults.

In some respects, learning to properly execute a golf swing is similar to learning to play a musical instrument such as the piano. In both instances, one must engage in substantial practice in order to properly execute the necessary physical movements to accomplish the intended goal. In the case of learning to play the piano, one must train one's fingers to strike the proper keys in the proper order to make music. In the case of learning to properly execute a golf swing, one must train one's entire body to move in the proper position at all times during the swing in order to properly strike the golf ball. The principle difference between the two acts involves the lack of objective "keys" or positions in a golf swing as compared to most musical instruments. The keys on a piano are visible and in a fixed location and thus can be readily found and used as a reference point by one learning to play the piano. Moreover, when an improper key is struck, one can audibly detect the error and strive to correct it. In contrast, one learning to execute a golf swing has no objective positions, keys, or other reference points to consult. The golfer must find swing positions (i.e., the "keys") without any fixed visual, audible, or tactile guidance. Furthermore, it is sometimes difficult for a golfer to appreciate the difference between a properly struck golf ball and one which was not hit properly.

The golf training device according to the present invention provides the golfer with an objective set of "keys" that a golfer can use to locate proper, repeatable, consistent positions in a golf swing. Moreover, after practicing and learning the "key" positions of a properly executed golf swing using the golf training device according to the present invention, the golfer can use the device to practice and implement variations on a properly executed swing that can enhance and improve his or her golf game. Continuing with the piano analogy, the ability of the golfer to learn variations of the golf swing is similar to the pianist learning to strike the keys of a piano in various interpretive ways (e.g., long notes, crescendos, staccato notes, and other interpretive moves). The interpretive shots in golf, which are essential to achieving low scores, involve varying such things as swing tempo, softness of shots, grip pressure, the angle of the blade of the club relative to the swing path, and other minor adjustments. In all cases, however, it is essential that the golfer have a constant set of positions or "keys" to serve as a reference point for the swing.

Another feature of the invention involves the ability of a golfer to use the device to quickly recover a proper swing after a lay off from playing golf or other periods of inactivity. Since there are generally no objective keys in a golf swing to serve as a frame of reference, a golfer who does not swing a golf club for a few days will begin to lose the feeling of correct swing positions. However, through use of the golf training device of the instant invention, the golfer can return from a lay off to reasonable performance levels after a comparatively short period of practice because the device will help the golfer recall the "keys" or positions of a properly executed golf swing. Rapidly refreshing one's muscle memory and muscle tone for a golf swing can heighten a golfer's enjoyment of the game of golf and raise the golfer's confidence on the golf course.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A golf training device adapted to engage the grip end of a golf club and the arms of a golfer while the golfer executes a golf swing, the golf training device comprising:

a rod defining a longitudinal axis and having first and second ends;

a yoke assembly connected at the first end of the rod, the yoke assembly comprising a pair of opposing arm restrainers through which the arms of the golfer pass, said arm restrainers contacting and engaging a portion of the golfer's arms distal to the rod to provide resistance if the golfer attempts to separate his or her arms, thereby maintaining the golfer's arms in a predetermined relationship with respect to each other and the rod throughout the golf swing;

a coupler for engagement with the grip end of the golf club; and a hinge connecting the coupler to the second end of the rod, the hinge having a pivot axis being disposed generally perpendicular to the longitudinal axis.

2. The golf training device as in claim 1, wherein the yoke assembly is connected at the midpoint of its length to the first end of the rod.

3. The golf training device as in claim 2, wherein the longitudinal axis of the rod and the pivot axis of the hinge define a plane, and the opposing arm restrainers of the yoke assembly are equally bisected by said plane.

4. The golf training device as in claim 3, wherein the connection between the yoke assembly and the rod permits rotation of the yoke assembly relative to the rod on the longitudinal axis such that the opposing arm restrainers of the yoke assembly are not equally bisected by the plane.

5. The golf training device as in claim 4, further comprising a locking pin which when engaged restricts the rotation of the yoke assembly relative to the rod, and fixes the orientation of the opposing arm restrainers relative to the plane.

6. The golf training device as in claim 1, wherein the length of the rod along the longitudinal axis is adjustable.

7. The golf training device as in claim 6, wherein the length of the rod can be adjusted such that the opposing arm restrainers can make contact with the golfer's arms either above or below the golfer's elbow.

8. The golf training device as in claim 1, wherein the coupler comprises an alligator clamp assembly.

9. The golf training device as in claim 8, wherein the alligator clamp assembly comprises an upper jaw and a lower jaw each connected to a pair of opposing hinge plates, the upper jaw and the lower jaw having ridges on their facing surfaces for frictionally engaging the grip end of a golf club when the upper jaw and lower jaw are clamped together.

10. The golf training device as in claim 1, wherein the coupler comprises a socket formed from a resilient material to frictionally engage the grip end of a golf club.

11. The golf training device as in claim 1, wherein the rod is constructed from aluminum.

12. The golf training device as in claim 1 wherein the hinge further comprises a spring-loaded detent element which bears against the hinge and emits an audible click as the coupler rotates on the pivot axis relative to the rod.

13. The golf training device as in claim 1 further comprising a spacer for attachment to one of the arm restrainers.

14. The golf training device as in claim 1 further comprising a stop for limiting the rotation of coupler relative to the rod on the pivot axis when said coupler is engaged with the grip end of a putter.

15. A golf training device as in claim 1 further comprising indicia to help determine the proper orientation of the leading edge of a golf club relative to said pivot axis when said golf club is being attached to said coupler.

16. The golf training device as in claim 1, wherein the coupler comprises a channel for receiving the grip end of the golf club.

17. The golf training device as in claim 1, wherein the rod has a generally planar shape in cross-section.

18. The golf training device as in claim 1, wherein the yoke assembly further comprises an elastic band that extends from each opposing arm restrainer to the rod to define an opening through which the golfer's arms pass.

19. A golf training device adapted to engage the grip end of a golf club and the arms of a golfer while the golfer executes a golf swing, the golf training device comprising:

a rod defining a longitudinal axis, said rod comprising a tubular upper section, a cylindrical middle section, and a lower section, said tubular upper section having an open end and a closed first end, said cylindrical middle section having one end disposed within said open end of said tubular upper section and another end rotatably connected to said lower section such that the axis of rotation is the same as the longitudinal axis defined by the rod, said lower section terminating in a tongue portion, a yoke assembly connected to said closed first end of said tubular upper section so as to permit rotation of said yoke assembly on an axis perpendicular to said longitudinal axis, said yoke assembly comprising a pair of opposing arm restrainers through which the arms of the golfer pass, said arm restrainers contacting and engaging a portion of the golfer's arms distal to the rod to provide resistance if the golfer attempts to separate his or her arms, thereby maintaining the golfer's arms in a predetermined relationship with respect to each other and the rod, said arm restrainers comprising tubular members covered with a resilient material, a coupler for engagement with the grip end of the golf club, said coupler comprising an alligator clamp assembly, and a hinge connecting said coupler to said tongue portion of said lower section of said rod, the hinge having a pivot axis being disposed perpendicular to the longitudinal axis.

20. The golf training device as in claim 19 wherein said tubular upper section is provided with a series of openings and said middle section is provided with a series of threaded bores perpendicular to said longitudinal axis, the length of said rod being adjustable by aligning an opening with a threaded bore and inserting a threaded adjustment pin therethrough.

* * * * *